United States Patent [19]

Jaeger

[11] Patent Number: 4,468,192

[45] Date of Patent: Aug. 28, 1984

[54] CONTROL SYSTEM FOR CONTROLLING THE FUEL/AIR RATIO OF COMBUSTION APPARATUS

[75] Inventor: Thomas S. Jaeger, Crystal, Minn.

[73] Assignee: Honeywell Inc., Minneapolis, Minn.

[21] Appl. No.: 509,833

[22] Filed: Jul. 1, 1983

[51] Int. Cl.[3] ..... F23M 3/00

[52] U.S. Cl. ..... 431/20; 431/90

[58] Field of Search ..... 431/19, 20, 90

[56] References Cited

U.S. PATENT DOCUMENTS

| | | |
|---|---|---|
| Re. 24,410 | 12/1957 | Drake . |
| 1,999,740 | 4/1935 | Schmidt et al. . |
| 2,251,019 | 7/1941 | Mawha . |
| 3,015,357 | 1/1962 | Bain et al. . |
| 3,277,947 | 10/1966 | Gacioch . |
| 3,801,007 | 4/1974 | Branson et al. . |
| 3,973,898 | 8/1976 | Seider . |
| 3,985,294 | 10/1976 | Guido et al. . |
| 4,251,025 | 2/1981 | Bonne et al. . |
| 4,334,855 | 6/1982 | Nelson . |
| 4,340,355 | 7/1982 | Nelson et al. . |

*Primary Examiner*—Carroll B. Dority, Jr.
*Attorney, Agent, or Firm*—Clyde C. Blinn

[57] ABSTRACT

A control system for an induced or forced draft combustion apparatus has a single pressure transducer for providing an electrical signal indicative of pressures by alternately responding to the fuel pressure to the combustion apparatus and the fuel pressure plus the induced draft lower suction pressure. The signal output of the transducer is connected to a controller for controlling the fuel flow to maintain a predetermined fuel/air ratio for efficient and safe combustion of the fuel in the combustion apparatus.

2 Claims, 4 Drawing Figures

CONTROL SYSTEM FOR CONTROLLING THE FUEL/AIR RATIO OF COMBUSTION APPARATUS

BACKGROUND AND SUMMRY OF THE INVENTION

With the advent of induced draft combustion apparatus for furnaces and the increased cost of fuel, in particular natural gas, continued research and development is being made to provide a control system for near stoichiometric control or fuel/air ratio control of the combustion of fuel in furnaces. In furnaces where the amount of air supplied to the combustion chamber by the induced draft blower can be changed by many environmental situations or from application to application for a given furnace design, the need of a control system for adjusting the fuel/air ratio with the changes in air flow has greatly increased.

The present invention makes use of a single pressure transducer apparatus for providing an output signal indicative of the pressure to which the transducer is exposed. By alternately connecting the transducer so that it responds to the pressure of the fuel to the burner of the furnace or to the pressure of the fuel plus the suction of the induced draft blower, an output signal is available to a controller. The fuel control valve is modulatingly controlled to maintain combustion in the furnace with a predetermined fuel/air ratio for maximum efficiency. Specifically, the single transducer means is alternately connected by means of a valve to respond to the difference between gas pressure and atmospheric pressure or blower pressure to obtain the signal having two levels depending upon the sensed pressures. By means of a summing network these pressure signals can effectively control a modulating valve and thus the fuel control to the burner to maintain the proper fuel/air ratio as the supplied quantity of combustion air changes.

BRIEF DESCRIPTION OF THE DRAWINGS

In the accompanying drawings, forming a material part of this disclosure.

DESCRIPTION OF THE INVENTION

Figure 1:
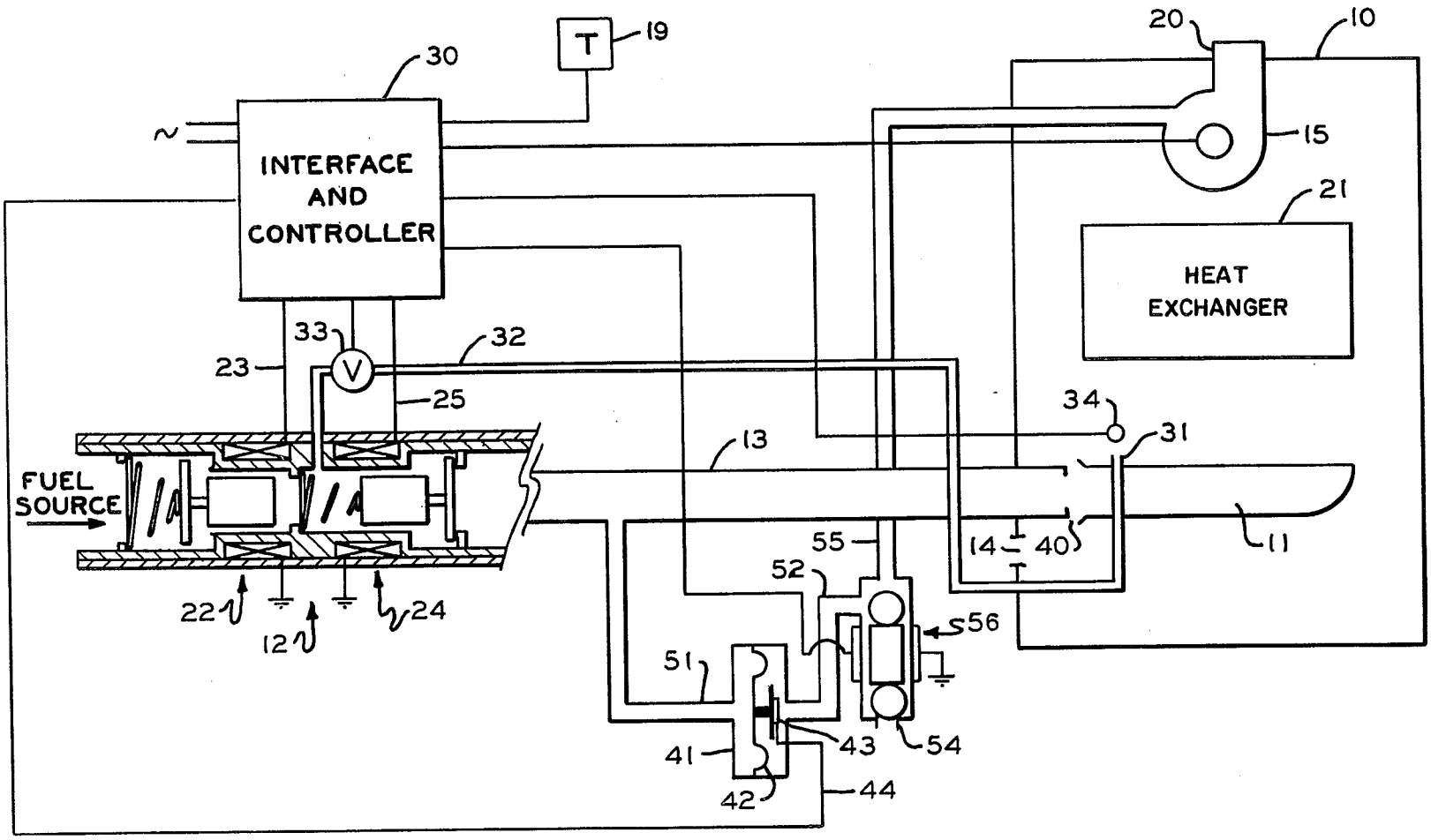
FIG. 1 is a schematic representation of the control system for modulatingly controlling the fuel flow to the burner.

Referring to FIG. 1, an induced draft combustion apparatus or furnace 10 of the type disclosed in the Lorne W. Nelson, et al, U.S. Pat. No. 4,340,355, issued July 20, 1982, and U.S. Pat. No. 4,334,855, issued June 15, 1982, has a burner 11 to which fuel or gas is supplied to a burner 11 from a source through a valve 12 and a pipe 13. Combustion air to burner 11 is supplied through an opening 14 by an induced draft blower 15 adapted to be connected to the exhaust stack 20. Other types of forced air supply systems can be used. Upon operation of the furnace, a conventional heat exchanger 21 is heated to supply heated medium, whether air or water, to a space in which the temperature is being controlled by a thermostat 19.

Valve 12 has a first portion 22 for providing an ON/-OFF operation when controlled over a circuit 23 and a second portion 24 for ON/OFF and modulatingly controlling the flow of fuel depending upon a signal over circuit 25. Valve 22 opens wide open upon the presence of a signal. Valve 24 first moves to open one side and then vary the position on the other side by an amount depending upon the level of the signal from controller or interface and controller unit 30. A conventional pilot 31 associated with burner 11 receives gas through a pipe 32 under the control of a pilot valve 33 whenever ON/-OFF valve 22 is open. The pilot flame is proven by a conventional pilot igniter and sensor 34 whether it be a conventional thermocouple or electrical flame responsive sensor. Upon the supply of gas to pilot 31 and the proving of the pilot by the pilot sensor 34, controller opens valve 24 to supply gas through pipe 13 and combustion air through opening 40 to burner 11.

Figure 3:
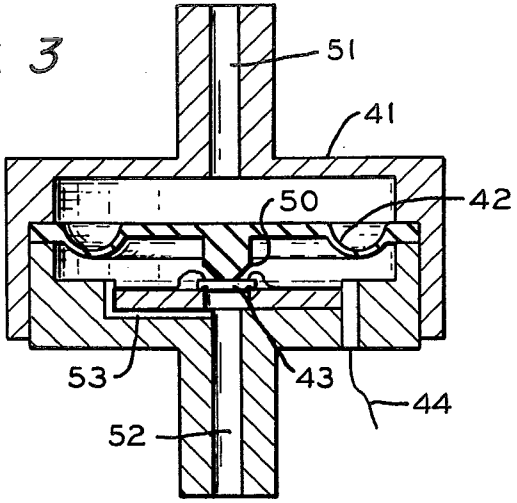
FIG. 3 is a pressure to electric transducer used in the system of FIG. 1.

A transducer 41 of FIGS. 1 and 3 has a pressure responsive means or diaphragm 42 for applying a force by projection 50 on a crystal 43 to provide an electrical output signal over circuit 44 indicative of the pressure differential experienced across diaphragm 42. Diaphragm 42 is responsive to the pressure difference between a pressure through conduit 51 and conduit 52 which opens to the under side of diaphragm through passage 53. The difference in pressure across the diaphragm loads element 43 to provide an output signal indicative of the differential pressure. Transducer opening 51 is connected to pipe 13 supplying gas to the burner.

Figure 2:
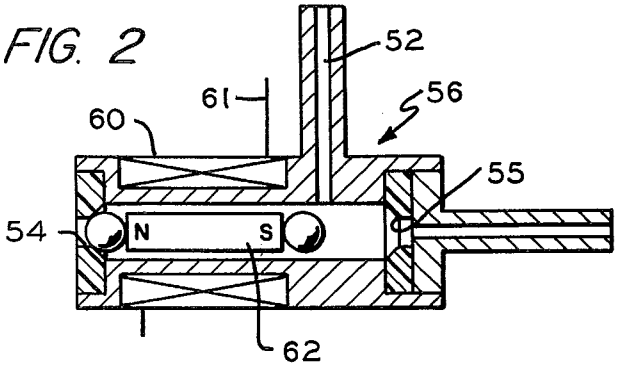
FIG. 2 is a switching valve used in the system of FIG. 1.

By conduit 52, a switching changeover valve 56 alternately connects one side of the pressure transducer to either atmosphere through opening 54 or the blower intake pressure through conduit 55. Specifically, valve 56 as shown in FIG. 2 has an electric solenoid or coil 60 energized with a DC current pulse over a conductor 61 to move magnet 62 in the position shown when energized with a DC current pulse of opposite polarity or in a position to the far right to close opening 55 and open opening 54. By alternating the DC current pulse to the valve 56, one side of transducer means 41 is either connected to atmosphere to opening 54 or to the blower intake 55. A pressure differential signal is obtained over circuit 44 indicative of the fuel or gas pressure $P_g$ or the gas pressure plus the blower suction pressure $P_g+P_b$. The voltage signal over circuit 44 of these two parameters is then used by controller 30 to maintain the proper fuel/air ratio.

Figure 4:
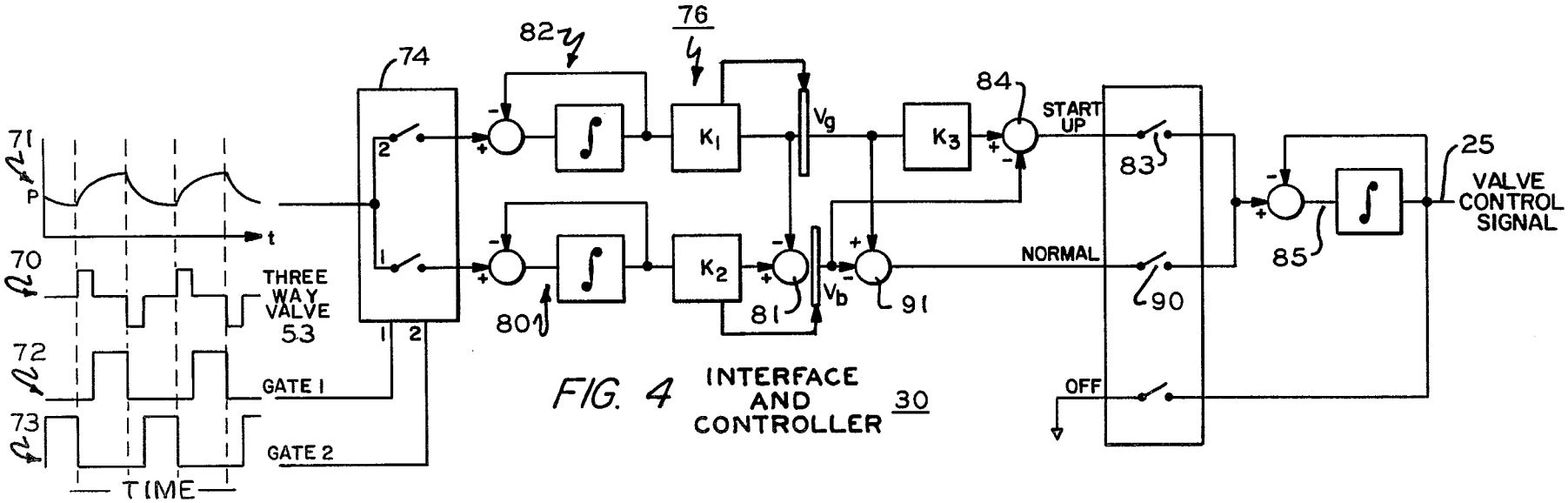
FIG. 4 is a schematic diagram of the operation of the controller of FIG. 1 for making use of the signal from the transducer for controlling the modulating valve.

Controller 30 is partially shown schematically in FIG. 4. A conventional interface provides for the operation by sources of conventional timing voltage signals shown. Signal 70 provides for the operation of the three-way valve 56 to energize the valve in one position or the other. When the voltage pulse is positive, the valve is energized in the position shown to connect the transducer to the blower suction pressure. With the negative voltage the valve 56 is energized to close passage 55 and connect the transducer to atmospheric pressure through opening 54. With this operation the pressure as shown in 71 varies from the low pressure being that of fuel or gas to the higher pressure of the gas plus the suction pressure of the blower. The interface apparatus simultaneously provides for voltage pulses 72 and 73 to operate the electrical gates or switches 1 and 2 shown in apparatus 74 to allow one or the other of the pressure signals shown in 71 to be applied to the network 76 of controller.

When gate 1 is closed, the high pressure of the fuel and blower combined is applied to the controller circuit. The circuit comprises the integrating and feedback network 80 and the summing network 81. Simultaneously, on the alternate cycle, when gate or switch 2 is closed, the signal indicative of the low pressure or gas pressure is fed into the integrating and summing feedback circuit 82 to summing network 81 whereby the output of the summing network 81 as fed to the constant network $K_2$ is a voltage $V_b$ indicative of the pressure of the blower.

For a start-up operation, a switch 83 is closed and a rich or lean mixture of gas is supplied to the burner depending upon the constant $K_3$, the gas pressure signal and blower pressure signal over the summing network 84 to effect control of the valve through the integration and feedback network 85. Constant $K_3$ provides a richer or leaner gas mixture for ignition, depending on the type of furnace used. After sufficient operation is established to result in normal operation, switch 90 is closed. The output of the summing apparatus 91 is used to control the modulating valve making use of the voltage $V_g$ indicative of the gas pressure and the voltage $V_b$ indicative of the blower pressure to maintain the gas valve operation at a predetermined fuel/air ratio to the combustion apparatus for efficient operation.

OPERATION OF THE INVENTION

Referring to FIG. 1, assuming that the thermostat 19 calls for heat, unit 30 energizes the ON/OFF valve 22 to an open position as shown and fuel from a fuel source connected to valve 12 flows to the other parts of the system depending upon its operation. The simultaneous operation of valve 33 admits pilot gas to the pilot burner 31 to be ignited by igniter 34. Once the flame is proven, the operation of the burner is started. Simultaneously, blower 15 is energized at some predetermined speed to supply combustion gas to the burner compartment through the opening 14. Valve 33 is an option that need not be included since valve 22 will serve as ON/OFF for the pilot gas.

Controller 30 cycles the operation of the change-over valve 56 to respond to the alternate signals indicative of gas pressure and gas and blower pressure and through the controller circuit as shown in FIG. 4, the start up of the burner is completed through switch 83. Once combustion is in operation, a normal control is accomplished through the circuit when switch 90 is closed. The cycling of changeover valve 56 compares the gas pressure to the sums of the gas pressure and blower pressure and maintains the position of modulating valve 24 through the output of 43 by circuits 44 and 25 such that the fuel flow to the burner accomplishes the desired fuel/air ratio. Any change in the blower pressure such as a change in the speed of the blower is accomplished in many induced draft furnaces, the fuel/air ratio is maintained at some selected value as a reduction in air flow results in a reduction in the fuel by reducing the fuel flow through the modulating valve 24.

The embodiments of the invention in which an exclusive property or right is claimed are defined as follows:

1. In an improvement to a control system for maintaining the fuel/air ratio of an induced draft furnace at a predetermined value by sensing the pressure of the fuel delivered to a burner and a pressure indicative of the induced air and controlling a fuel flow control means to maintain said predetermined value, the improvement comprising, a single pressure transducer means providing an output indicative of pressure, valve means for alternatively connecting said transducer means to respond alternately to the pressure of the fuel delivered to the furnace and the sum of the pressure of the fuel and the suction pressure of the induced draft, and control means connected to respond to said output of said transducer means and to control said fuel flow control means to control the fuel flow to the burner to maintain said predetermined fuel/air ratio for efficient and safe fuel combustion.

2. A control system for a furnace with an induced draft blower for maintaining a predetermined fuel/air ratio for efficient and safe combustion of the fuel delivered to a burner, comprising, fuel control valve means adapted to connect a source of fuel to the fuel burner of a furnace to modulatingly controlling the fuel flow, pressure transducer means providing alternate signals indicative of the difference of two pressures, means connecting one side of said pressure transducer means to respond to the fuel pressure of fuel delivered to the burner, switching valve means having at least two positions, said valve means alternately connecting another side of said pressure transducer means to atmospheric pressure when in one position and to the induced draft pressure when in a second position, and control means connected to respond to said alternate output signals of said pressure transducer means and connected to control the operation of said fuel control valve means to maintain a fuel flow for providing a predetermined fuel/air ratio.

* * * * *